United States Patent [19]

McQuary et al.

[11] Patent Number: 4,597,693

[45] Date of Patent: Jul. 1, 1986

[54] METHOD AND APPARATUS FOR INSTALLING HIGHWAY DRAINAGE MAT

[75] Inventors: Charles R. McQuary, Chesterfield, Mo.; Barry J. Dempsey, White Heath, Ill.

[73] Assignee: Monsanto Company, St. Louis, Mo.

[21] Appl. No.: 761,217

[22] Filed: Jul. 31, 1985

Related U.S. Application Data

[63] Continuation-in-part of Ser. No. 480,656, Mar. 31, 1983, abandoned, and a continuation-in-part of Ser. No. 497,764, May 24, 1983, abandoned.

[51] Int. Cl.[4] ..... E02B 11/00; E02D 31/02; F16L 1/02

[52] U.S. Cl. ..... 405/176; 404/2; 405/50; 405/179

[58] Field of Search ..... 405/36, 38, 50, 174, 405/176, 177, 179; 404/2, 3, 4, 5, 71, 72

[56] References Cited

U.S. PATENT DOCUMENTS

| | | | |
|---|---|---|---|
| 2,192,369 | 3/1940 | Sparrow | 404/3 |
| 3,182,459 | 5/1965 | Grether et al. | 405/115 |
| 3,292,379 | 12/1966 | McElvany | 405/179 |
| 3,327,484 | 6/1967 | Launder et al. | 405/176 |
| 3,590,588 | 7/1971 | Draper et al. | 405/176 |
| 3,830,373 | 8/1974 | Sixt et al. | 210/489 |
| 3,876,322 | 4/1975 | Deason | 404/2 |
| 4,028,902 | 6/1977 | Courson et al. | 405/177 |
| 4,043,135 | 8/1977 | Klaus et al. | 405/174 |
| 4,397,241 | 8/1983 | Newman | 405/38 |
| 4,440,088 | 4/1984 | Wallace et al. | 405/38 |

FOREIGN PATENT DOCUMENTS

| | | |
|---|---|---|
| 075993 | 6/1983 | European Pat. Off. . |
| 2550735 | 5/1977 | Fed. Rep. of Germany . |
| 3012980 | 10/1981 | Fed. Rep. of Germany . |
| 982956 | 2/1965 | United Kingdom . |

OTHER PUBLICATIONS

Agricultural Engineering, vol. 43, No. 9, Sep. 1962, Fouss et al, pp. 512-513, FIG. 3.

*Primary Examiner*—David H. Corbin
*Attorney, Agent, or Firm*—Thomas E. Kelley

[57] ABSTRACT

Method and apparatus for inserting an elongated bendable drainage mat having a rectangular cross section below the surface of the ground in a vertical orientation in an advancing trench segment.

4 Claims, 10 Drawing Figures

METHOD AND APPARATUS FOR INSTALLING HIGHWAY DRAINAGE MAT

This application is a continuation-in-part of application Ser. No. 480,656, filed Mar. 31, 1983, now abandoned, and application Ser. No. 497,764, filed May 24, 1983, now abandoned, both of which are incorporated herein by reference.

BACKGROUND OF THE INVENTION

This invention relates to a method and apparatus for inserting an elongated, bendable drainage mat having a rectangular transverse cross section below the surface of the ground in a vertical orientation. Such drainage mat comprises a polymeric core having a plurality of substantially rigid fingers extending from one side of a layer and an enveloping water-permeable fabric. Such drainage mat is particularly advantageous, for instance as highway edge drain.

The need for drainage systems for highways and other applications has been well known for years, perhaps for several hundred years or more. As the knowledge of the effects of water on the stability of subsurface soil has increased, the design of drainage systems has evolved with new materials of constructions, such as synthetic polymeric engineering fabrics and polymeric conduits and collectors. A major advance in drainage materials is an elongated bendable drainage mat having a rectangular transverse cross section where said drainage mat comprises a polymeric core having a plurality of substantially rigid fingers extending from side of a layer and an enveloping water-permeable fabric. Such drainage mat is disclosed in copending patent applications Ser. No. 481,104, filed Mar. 31, 1983 and application Ser. No. 480,990, filed Mar. 31, 1983, both of which are incorporated herein by reference.

Some drainage material, either because of excess rigidity or difficulty in handling, must be installed, for instance in a highway edge drain application by excavating a considerable length of trench, hauling away the excavated material, inserting the drainage product in the trench and refilling the trench with coarse fill which is substantially pervious to water. Such drainage systems are disadvantageous on the basis of substantial cost to install, for instance in terms of labor for excavation, installation and backfilling as well as costs associated with haulage of excavated and clean backfill material.

Some improvements in installation methods have been achieved by the use of drainage material such as fabric-covered perforated polymeric conduit such as disclosed by Sixt et.al. in U.S. Pat. No. 3,830,373. Installation of such fabric-covered perforated polymeric conduit is facilitated by the use of machine installation apparatus wherein sets of rollers can be utilized to pick up such drainage material lying on the ground and direct the material into the bottom of a trench. Such rollers are conveniently installed in a boot which is advancing in an excavated trench. Such apparatus is readily useful only for multidirectionally flexible drainage material such as flexible polymeric pipe. The elongated bendable drainage mat having a rectangular transverse cross section described above is not multidirectionally bendable but rather is readily bendable only into one of its major surfaces. In this regard the following definitions are useful in describing such drainage mat and the method and apparatus of this invention for installing such drainage mat.

The term "elongated drainage mat" as used in this application refers to a drainage mat having a length substantially larger than its width or depth.

The term "axis of elongation" as used in this application refers to the axis passing through the center of an elongated drainage mat along its length.

The term "transverse rectangular cross section" as used in this application refers to a cross section of an elongated drainage mat in a plane normal to the axis of elongation of the drainage mat.

The term "pointing" as used in this application means a direction in which the axis of elongation of an elongated drainage mat is extended or aimed.

An elongated drainage mat is said to be "vertically-pointed" when the axis of elongation of the drainage mat is generally vertical with respect to the surface of the earth.

An elongated drainage mat is said to be "horizontally-pointed" when the axis of elongation of the drainage mat is generally horizontal with respect to the surface of the earth.

The term "orientation" as used in this application refers to the attitude of an elongated drainage mat having a rectangular transverse cross section determined by the relationship of the axes of the rectangular transverse cross section.

An elongated, horizontally-pointed drainage mat having a rectangular transverse cross section is said to be "vertically-oriented" when the axis of the rectangular transverse cross section having the larger dimension is in a vertical position and similarly, the axis of the rectangular transverse cross section having the smaller dimension is in a horizontal position. The same drainage mat, when rotated 90° around its axis of elongation, is said to be "horizontally-oriented".

This invention overcomes the disadvantanges of methods and apparatus for installing drainage materials such that elongated bendable drainage mat having a rectangular cross section and bendable only into one of its major surfaces can be readily and advantageously installed below the surface of the ground in a vertical orientation in an advancing trench segment.

SUMMARY OF THE INVENTION

This invention provides a method for inserting an elongated, bendable drainage mat having a rectangular transverse cross section below the surface of the ground in a vertical orientation. The drainage mat comprises a polymeric core having a plurality of substantially rigid fingers extending from one side of a layer and an enveloping water permeable fabric. The method comprises (a) excavating an advancing trench segment; (b) pulling a boot horizontally along the bottom of the excavated advancing trench segment; wherein said boot comprises means for vertically pointing a horizontally-pointed drainage mat and means for horizontally pointing a vertically-pointed drainage mat; (c) feeding a horizontally-pointed drainage mat sequentially to said means for vertically pointing and to said means for horizontally pointing; wherein said horizontally-pointed drainage mat is deposited at the bottom of said excavated advancing trench segment in a vertical orientation; and (d) filling the trailing end of the excavated advancing trench segment having said vertically oriented drainage mat.

In one preferred embodiment of the method a horizontally-pointed drainage mat is fed sequentially to said means for vertically pointing and to said means for horizontally pointing, where said means for vertically pointing and said means for horizontally pointing comprise fixed or rotating guides positioned with the axis at an angle of about 45° from horizontal.

This invention also provides apparatus for inserting an elongated, bendable, horizontally-pointed drainage mat below the surface of the ground in a vertical orientation in an advancing trench segment. The apparatus comprises means for vertically pointing a horizontally-pointed drainage mat and means for horizontally pointing a vertically-pointed drainage mat.

In a preferred embodiment of the apparatus the means for vertically pointing and means for horizontally pointing comprise guides positioned with the axes at an angle of about 45° from horizontal. The guides may be fixed or rotatable.

In another preferred embodiment of the apparatus the means for vertically pointing comprises at least one horizontal guide having its axis in a horizontal plane and the means for horizontally pointing comprises at least one guide having its axis at an angle of about 45° from horizontal.

Apparatus of this invention can further comprise a shoe for providing a drainage mat accepting a slot at the bottom of said trench, means for excavating an advancing trench segment and means for refilling the excavated trench segment with material, for instance which may have been excavated from the advancing trench segment, and means for directing to one side of said trench a horizontally-pointed drainage mat deposited at the bottom of said trench in a vertical orientation.

DESCRIPTION OF THE PREFERRED EMBODIMENTS

Figure 1:
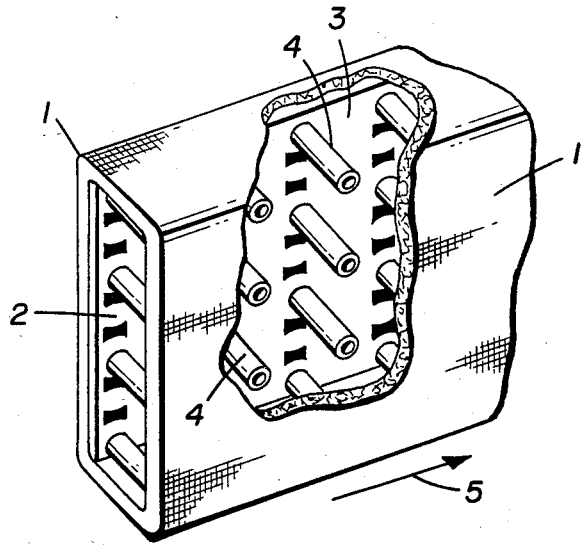
FIGS. 1, 2 and 3 illustrate drainage mat installable by the method and apparatus of this invention.
Figure 2:
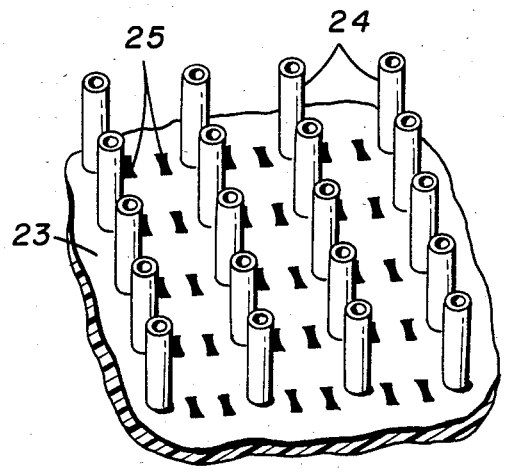
Figure 3:
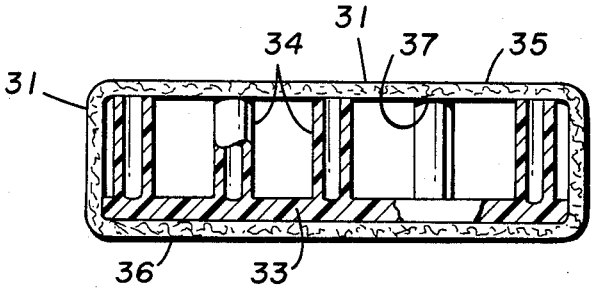

The method and apparatus of this invention readily allows installation below the surface of the ground in a vertical orientation of an elongated bendable drainage mat having a rectangular transverse cross section. FIGS. 1, 2 and 3 generally illustrate an embodiment of such drainage mat installable by the method and apparatus of this invention. With reference to FIG. 1 a water permeable fabric 1 envelops core 2 having a plurality of substantially rigid fingers 4 extending from one side of a layer 3. The direction of the axis of elongation of the mat is indicated by axis 5. FIG. 2 schematically illustrates an embodiment of a section of polymeric core useful in the drainage mat where the core has a plurality of hollow cylindrical fingers 24 extending from layer 23 having a multitude of perforations 25. FIG. 3 schematically illustrates a transverse cross section of drainage mat where fabric 31 envelops a core having a plurality of substantially rigid fingers 34 extending from one side of a layer 33. Such drainage mat is readily bendable into the surface 35 proximate the ends 37 of the fingers 34. That is, such drainage mat is readily bendable only such that the surface 35 proximate the ends 37 of the fingers 34 become concave, and the surface 36 proximate the layer 33 becomes convex.

Figure 5:
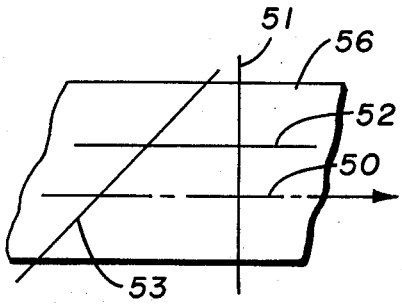
FIG. 5 schematically illustrates the position of bending axes with reference to the axis of elongation superimposed on the drainage mat surface which is proximate the ends of the fingers.

In this regard such drainage mat can not be folded upon itself into the surface 36 proximate the layer 33 without an undue amount of force which is likely to tear the fabric or deform or collapse the core. This is especially true when the fabric is bonded to the core. Such drainage mat is however readily bendable with little force such that the surface 35 proximate the ends 37 of the fingers 34 will readily and easily bend upon itself even up to about 180° around a bending axis having a radius of less than about 1 inch (2.54 cm) for instance as low as about 0.25 inches (0.62 cm). This bending into the surface proximate the ends of the fingers can be achieved around any bending axis parallel to the surface 35. In this regard FIG. 5 illustrates various bending axes superimposed on a drainage mat surface 56 proximate the ends of the fingers. Such bending axes are parallel to the surface 56 and are defined by their rotational disposition from axis of elongation 50 of the drainage mat. A bending axis can be rotationally disposed at any angle from 0° to 180° from the axis of elongation 50. For instance the bending axis 51 is normal to the axis of elongation 50 (that is, the bending axis 51 is rotationally disposed at an angle of 90° from the axis of elongation 50). The drainage mat can be folded upon itself around bending axis 51 resulting in a shorter length; or such mat can be rolled into a short cylindrical spiral roll. The bending axis 52 is parallel to the axis of elongation 50 (that is, the bending axis 52 is rotationally disposed at an angle of 90° from the axis of elongation 50). The drainage mat can be folded around bending axis 52 upon itself lengthwise or rolled into a long spiral roll.

Figure 6:
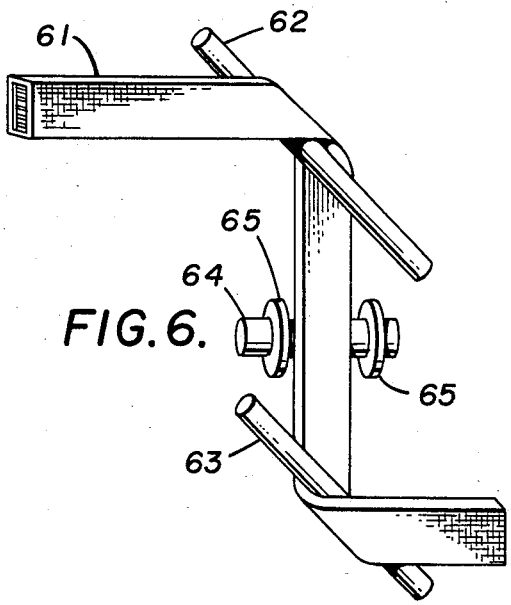
FIG. 6 schematically illustrates the characteristic of a drainage mat to change horizontal/vertical-pointing by rotating around a bending axis disposed at an angle of about 45° from the axis of elongation.

When the drainage mat is folded upon itself up to about 180° on a bending axis 53 which is rotationally disposed at an angle of 45° from the axis of elongation 50, the axis of elongation 50 of the drainage mat will effect a 90° bend, as illustrated in FIG. 6. This property of the drainage mat is particularly useful for those installations where the drainage mat 61 is to be installed below grade in a vertical orientation. In this regard the drainage mat can be provided in a vertical orientation above grade and directed to a fixed guide or a roller 62 at an angle of about 45°. The drainage mat directed around such a fixed guide or roller 62 will be normal to a horizontal plane and can be directed to a second fixed guide or roller 63 at an angle of about 45° at an elevation below grade. This second fixed guide or roller 63 will direct the drainage mat into a vertical orientation below grade in a position for its utilization. Such fixed guides are generally circular in cross section to facilitate the drainage mat sliding over their surface. Accordingly fixed guides will preferably have a smooth curved surface.

The fingers can comprise a very large group of shaped projections. As illustrated in FIG. 2 a preferred finger is a rod-like projection which is cylindrical and projects in a direction normal to the plane of the layer. Fingers of other shapes can be utilized for instance fingers having square, hexagonal, star or oblong cross-sectional shape or with fins, etc. Although solid fingers can be utilized, it is often desired that the fingers be hollow both for ease of fabrication and for minimizing the mass of the core to facilitate installation.

To provide a core with a maximum amount of cross-sectional area for fluid flow with the minimum resistance provided by fingers it is desirable to provide a maximum spacing between fingers. However, fingers must not be spaced so far apart that the fabric will collapse into the space between fingers because of a lack of support. In this regard the core is often provided with an optimum spacing of fingers which can be characterized as an average center spacing, that is, the distance between centers of fingers intercepting the base. Average center spacing can range from about 1 cm to 10 cm.

Cores having utility in the drainage mat of this invention can have fingers of a wide range in length, for instance from about 1 cm to 10 cm.

The depth of drainage mat, that is the smaller dimension of its rectangular transverse cross section, will be approximated by the length of the fingers, for instance about 1 cm to 10 cm. The length of the drainage mat can be very long, for instance up to about 400 feet (122 meters) or more. The width of the drainage mat, that is, the larger dimension of its transverse rectangular cross section, is often at least 7 cm and can range from 15 cm to more than 150 cm, say even up to 365 cm or more. The width will depend on the size of the apparatus used to fabricate the core. Larger sizes can be fabricated by fastening two or more widths of core.

Because of a tendency of the drainage mat to bow out from the bending axes of rollers 62 and 63, it is often desirable to utilize at least one guide 64 to restrain the curvature of the drainage mat passing from guide 62 to guide 63. Guide 64 can be fixed or rotatable. In some cases, it may be advantageous to pass the drainage mat between two generally horizontal guides 64. Because guide 64 is at an angle of 90° from the axis of elongation of the drainage mat, it is often advantageous to utilize guide flanges 65. Such guide flanges 65 provide means for locating the advancing drainage mat, for instance in a central position on angularly oriented guides, such as guides 62 and 63.

Figure 4:
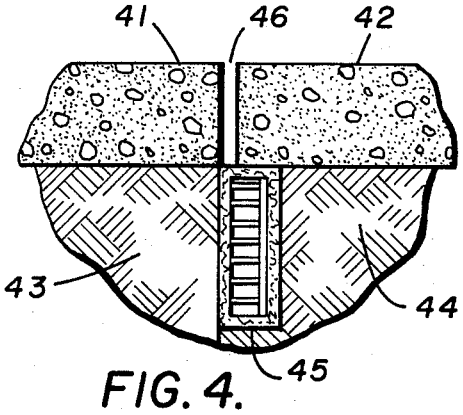
FIG. 4 schematically illustrates a cross-sectional view of a highway system with drainage mat installed by the method and apparatus of this invention.

A large surface area available for drainage is provided by such rectangular transverse cross section of the drainage mat. This is particularly advantageous in those instances where the drainage mat is installed such that the larger of its transverse cross-sectional dimensions is normal to an area to be drained. One such advantageous installation is in a highway system where the drainage mat is installed parallel to a road, for instance in a vertical orientation under a highway shoulder joint. In this regard FIG. 4 illustrates a highway system comprising concrete pavement 41 with an adjoining paved shoulder 42. The concrete pavement 41 overlies a support bed 43. The paved shoulder overlies support 44. In such an installation water infiltrating in a vertical direction through the highway shoulder joint 46 can be intercepted by the narrow transverse cross-sectional area at the top of the drainage mat 45, water present under the highway can be intercepted by the large transverse cross-sectional area which is normal to the highway support bed, and the opposing large transverse cross-sectional area can intercept ground water approaching the highway from the outside. All such intercepted water can be carried away as soon as it is collected by the drainage mat. The mat, of course, can be installed in other locations with respect to the pavement shoulder joint.

Figure 7:
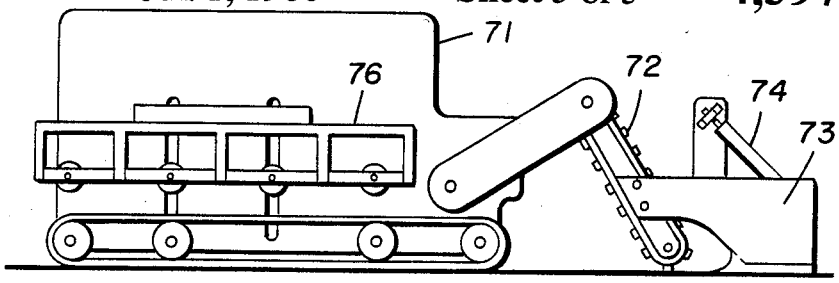
FIGS. 7 and 8 schematically illustrate a partial side view of apparatus of this invention.
Figure 8:
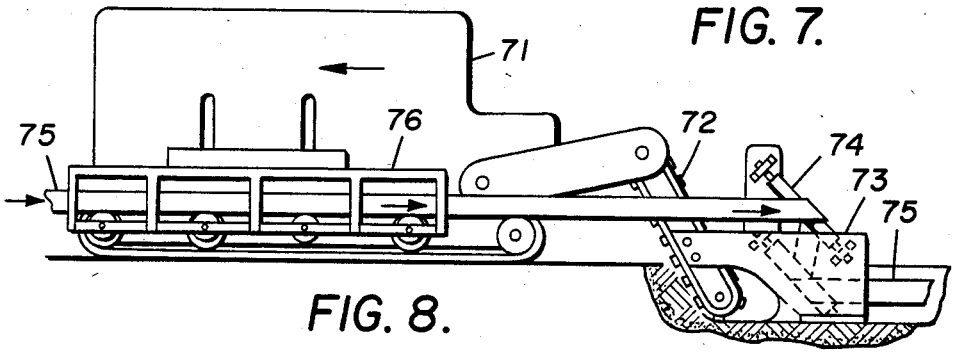

This invention provides a method for installing such drainage mat below the surface of the ground in a vertical orientation, for instance as shown in FIG. 4. The method comprises (a) excavating an advancing trench segment; (b) pulling a boot horizontally along the bottom of the excavated advancing trench segment; wherein said boot comprises means for vertically pointing a horizontally-pointed drainage mat and means for horizontally pointing a vertically-pointed drainage mat; (c) feeding a horizontally-pointed drainage mat sequentially to said means for vertically pointing and to said means for horizontally pointing; wherein said horizontally-pointed drainage mat is deposited at the bottom of said excavated advancing trench segment in a vertical orientation; and (d) filling the trailing end of the excavated advancing trench segment having said vertically oriented drainage mat. The advancing trench segment can be excavated by use of trenching equipment such as plows, trenching wheels or trenching chains. Often such trenching wheels or trenching chains have hardened cutting surfaces, such as carbide tipped cutting teeth. Such trenching equipment is illustrated in FIGS. 7 and 8 which generally shows a mobile power unit 71 towing a boom-mounted chain trencher 72. Such mobile power unit can be track or wheel driven. A boot 73, attached to the trencher 72, is pulled through the excavated trench. The boot is pulled horizontally along the bottom of the excavated trench.

The boot is equipped with means for vertically pointing a horizontally-pointed drainage mat and means for horizontally pointing the vertically-pointed drainage mat. As illustrated in FIGS. 7 and 8, the means for vertically pointing a horizontally-pointed drainage mat 75 can comprise a guide 74 having its axes at an angle of about 45° from horizontal. When the boot 73 is equipped with such means for vertically pointing a horizontally-pointed drainage mat (for example, a fixed guide or a roller 74 having its axis at an angle of about 45° from horizontal), then the boot should utilize a second guide also having its axis at an angle of about 45° from horizontal as the means for horizontally pointing the vertically-pointed drainage mat as indicated by guide 63 in FIG. 6. In such a case it is also often desirable that the boot be equipped with a horizontal guide as indicated by guide 64 in FIG. 6.

Guides can be installed in the boot at angles other than about 45°. However, guides at about 45° generally provide a direct horizontal/vertical pointing for the drainage mat. In some instances it may be useful to have variable pitched guides on a pivoting mount to readily vary the depth to which the drainage mat is installed. In such a case the boot can be extendable to facilitate variations in installation depth.

A horizontally-pointed drainage mat 75 can be directed in a vertical orientation along the side of the mobile power unit 71 by guide means 76. The drainage mat is fed sequentially to the means for vertically pointing (for instance, a fixed guide or roller 74) and to said means for horizontally pointing. The drainage mat is then deposited at the bottom of the excavated advancing trench segment in a vertical orientation. The trailing end of the excavated trench segment having the vertically oriented drainage mat is then filled. It is often convenient to use the excavated material to fill the trench. This can be simply effected by the use of scraper blades, screws or conveyors attached to the boot. This greatly facilitates installation by eliminating the need to transport large quantities of soil.

Figure 9:
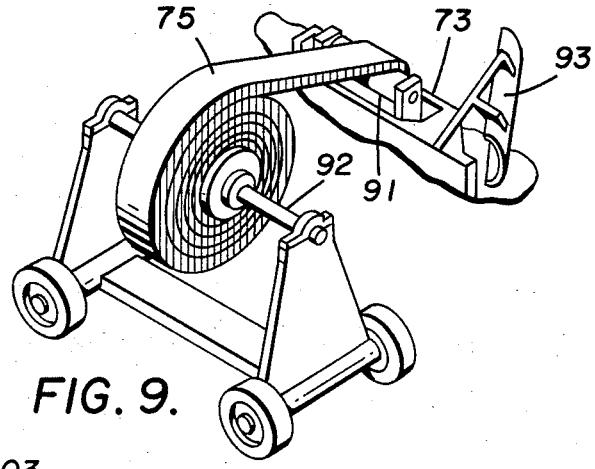
FIG. 9 schematically illustrates an alternative embodiment of part of the apparatus of this invention.

Referring now to FIG. 9, in other cases the boot 73 can be equipped with means for vertically pointing a horizontally-pointed drainage mat which comprises at least one guide 91 having its axis in a horizontal plane. The boot can then utilize a guide having its axis at about 45° to direct the vertically-pointed drainage mat to a horizontal orientation. FIG. 9 also illustrates an alternative mode of conveying and feeding the drainage mat to the boot. The drainage mat can be in a vertical spiral roll on a journal 92 supported on a wheeled-carriage which travels alongside the boot. Alternatively, horizontally oriented drainage mat lying alongside the intended path of the trench can be turned 90° toward the boot by means of a horizontal guide at an angle of 45° to the axis of the mat.

For ease of installation it is often advantageous to utilize a grooving shoe on the bottom of the boot. Such grooving shoe cuts a substantially square groove in the bottom of the trench. Such groove is generally shallow and has a width to accept the drainage mat and hold the drainage mat in a preferred location, usually to one side of the trench, prior to refilling the trench with soil or gravel. FIG. 9 also illustrates the use of a scraper blade 93 attached to the rear of the boot as a means for filling the excavated trench segment with excavated material.

Figure 10:
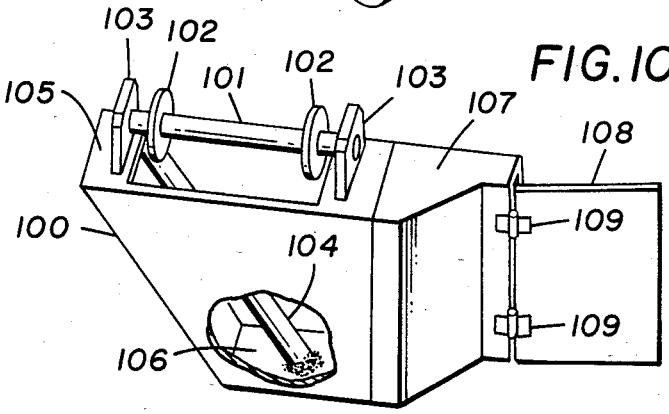
FIG. 10 schematically illustrates an embodiment of the apparatus of this invention.

Referring now to FIG. 10, a boot 100 can be equipped with means for vertically pointing a horizontally-pointed drainage mat which comprises a horizontal roller 101 having guide flanges 102, said roller being mounted on the boot at bearing blocks 103. As shown in the partial cutaway view of FIG. 10, the boot has a fixed guide 104 comprising, for instance, a 2½ inch diameter stainless steel pipe welded to the inside surface of the top plate 105 and bottom plate 106. Detachably connected to the trailing end of the boot is tapered chute 107 which has one rectangular open end corresponding to the rectangular open end of the boot. To position and direct the drainage mat to one side of the trench the other end of the tapered chute is horizontally offset and of narrower rectangular cross section to correspond to dimensions of the drainage mat. It is often convenient and desirable to affix a compacting plate 108 to the trailing end of the tapered chute. Convenient means of attaching the compacting plate to the tapered chute can comprise spring-loaded hinges 109. The compacting plate is useful in holding the drainage mat against one side wall of a trench while fill is added to the trench. The compacting plate can easily be pulled from the advancing fill being added to the excavated trench, thus ensuring that the drainage mat remains positioned at a desired side of the trench.

Conveniently the taped chute, including the optional compacting plate, can be rotated 180° to allow installation of the drainage mat on either side of the excavated trench.

While the invention has been described herein with regard to certain specific embodiments, it is not so limited. It is to be understood that variations and modifications thereof may be made by those skilled in the art without departing from the spirit and scope of the invention.

We claim:

1. A method for installing an elongated drainage mat parallel to a road in a vertical orientation under a shoulder joint comprising (a) providing an elongated length of drainage mat comprising a water permeable fabric enveloping a core for fluid flow wherein when said mat is in a vertical orientation, said mat presents a rectangular transverse cross section with a height greater than its width;

(b) excavating an advancing trench segment adjacent to the edge of a road surface under a shoulder joint wherein said trench has a depth greater than the height of said mat;

(c) pulling a boot along the bottom of the excavated advancing trench segment, wherein said boot comprises (i) a housing having two parallel sides extending from the bottom of the trench to a height above the trench, a closed front end and open top and rear ends; (ii) a guide within said housing for horizontally pointing a vertically pointed drainage mat, said guide being positioned at an angle of about 45° from horizontal wherein the upper end of the guide is forward of the lower end of the guide so that, as the drainage mat passes around said guide, the drainage mat can directly exit to the rear of the boot; (iii) means for laterally moving the vertically-oriented mat into contact with the roadside of the trench segment; and (iv) means for filling said excavated trench segment with material excavated from the advancing trench segment to hold a drainage may against the highway side of the trench segment;

(d) feeding said length of drainage mat sequentially through the top of said boot, around said guide and out through the open rear end of the boot, wherein said drainage mat is deposited at the bottom of said excavated advancing trench segment in a vertical orientation against the roadside of the trench segment; and (e) filling the trailing end of the excavated advancing trench segment with material excavated from the advancing trench segment to hold said drainage mat in a vertical orientation against the roadside of the trench segment.

2. The method of claim 1 the means for directing one side of the trench segment of said boot comprises a tapered chute having an inlet corresponding to the open rear end of said boot and a horizontally offset outlet, said outlet being narrower than the inlet.

3. The method of claim 2 wherein said means for directing to one side of the trench segment further comprises a spring loaded vertical plate trailing said tapered chute.

4. The method of claim 1 wherein means for filling is positioned sufficiently close to said means for laterally moving that the mat is in contact with the roadside of the trench at the point where said excavated material is returned to the trench segment.

* * * * *